US006088842A

United States Patent [19]

Barnett

[11] Patent Number: 6,088,842

[45] **Date of Patent: *Jul. 18, 2000**

[54] DRAIN ASSEMBLY FOR PREVENTING HAIR ENTANGLEMENT IN A POOL OR HOT TUB

[76] Inventor: Ralph L. Barnett, c/o Triodyne Inc., 5950 W. Touhy Ave., Niles, Ill. 60714-4610

[ * ] Notice: This patent issued on a continued prosecution application filed under 37 CFR 1.53(d), and is subject to the twenty year patent term provisions of 35 U.S.C. 154(a)(2).

[21] Appl. No.: 09/054,538

[22] Filed: Apr. 3, 1998

[51] Int. Cl.[7] ..... A47K 1/14

[52] U.S. Cl. ..... 4/286; 4/507; 4/496; 4/292

[58] Field of Search ..... 4/286, 288, 292, 4/507, 309, 281, 486, 508, 509, 510, 511, 512, 513

[56] References Cited

U.S. PATENT DOCUMENTS

| | | | |
|---|---|---|---|
| 720,365 | 2/1903 | Lewinski | 4/292 |
| 2,233,234 | 2/1941 | Wilson | 4/291 |
| 5,003,642 | 4/1991 | Robb et al. | 4/292 |
| 5,165,119 | 11/1992 | Yamato | 4/309 |
| 5,271,108 | 12/1993 | Wicke | 4/292 |

*Primary Examiner*—David J. Walczak

[57] ABSTRACT

A drain structure for disposal with a pool or hot tub where suction or vacuum forces are normally present. The drain has interiorly a plurality of grating members having lower surfaces adapted to facilitate release of entangled hair. In certain embodiments, the grating elements are cantilevered from the inner wall of the drain and having tapered lower release surfaces. In another embodiment, the lower surfaces comprise share lower edges for severing entangled hair.

7 Claims, 2 Drawing Sheets

DRAIN ASSEMBLY FOR PREVENTING HAIR ENTANGLEMENT IN A POOL OR HOT TUB

BACKGROUND OF THE INVENTION

This invention relates to drain constructions located in the bottom or along the sides of a pool or hot tub through which water flows under the action of gravity or a pump that acts to suck water out of the pool, and is related to Application Ser. No. 08/811,205 filed Mar. 5, 1997 entitled Apparatus for Preventing Hair Entanglement With or Adherence to a Drain in a Pool or Hot Tub.

The dangers inherent in pools and hot tubs having circulating water systems are well known and documented. Thus, for example, suction or vacuum forces frequently occur near the water drains sufficient to hold a swimmer or user fast in life threatening situations. Similarly, the entanglement or knotting of hair on or through a drain grate causes serious problems.

In the said co-pending application, there were described a number of drain structures for eliminating or alleviating some of the known problems. For example, that invention comprised a multicelled collimated grating of sufficient length so that human hairs either could not extend through the bottom of the grate or, even if very long hairs did so extend, the flow of water through the cells was laminar rather than turbulent to prevent hair knotting. Also disclosed was a collimated grating having a pronounced spherical top surface to prevent or minimize the formation of a dangerous vacuum when the grating is completely covered by a swimmer's body. That invention also taught the use of an unsecured grating so that a swimmer whose hair did become entangled could lift up the entire structure with his or her head.

Alternative structures which provide the same type of protection and problem solving are desirable.

SUMMARY OF THE INVENTION

The present invention comprises additional drain/grating structures for alleviating or eliminating dangerous hair entanglement or body adhering vacuum problems. In its broadest sense, the invention provides grating structures having surfaces adapted readily to release hair strands entangled or knotted thereon.

Briefly, the invention comprises a drain having a plurality of cantilevered grating elements. The cantilevered elements have gradual or sloping bottom surfaces which facilitate the sliding removal therefrom of hair strands that might become entangled or knotted on the elements. The drains may be circular or rectangular, and may also include a domed top structure which prevents body enclosing vacuum forces. In another embodiment, the grating elements comprise sharp cutting edges adapted to sever and release hair strands entangled or knotted thereover.

Numerous other advantages and features of the present invention will become apparent from the following detailed description of the invention, from the claims and from the accompanying drawings.

BRIEF DESCRIPTION OF THE DRAWINGS

In the accompanying drawings forming a part of the specification, and in which like numerals are employed to designate like parts throughout.

DETAILED DESCRIPTION OF THE INVENTION

Figure 1:
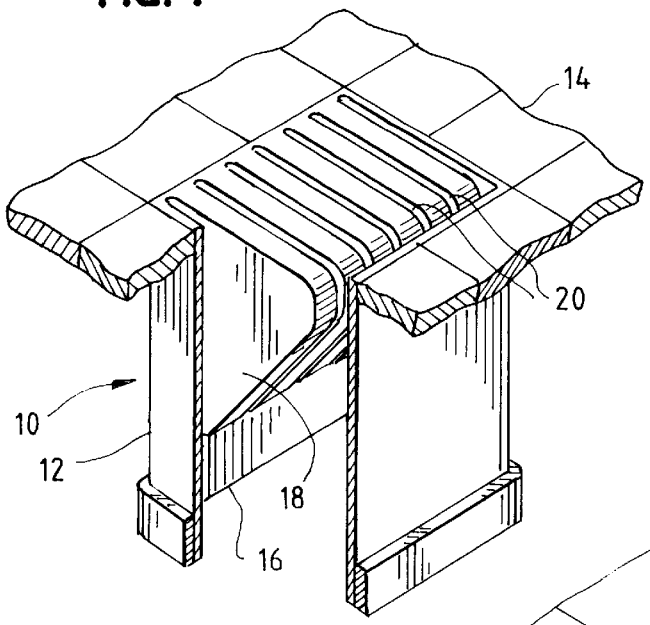
FIG. 1 is a fragmentary perspective view, with portions broken away, illustrating a preferred embodiment of the invention in rectangular form with cantilevered grating elements.

Referring to FIG. 1 of the drawings, it will be seen that the reference numeral 10 identifies generally a drain apparatus embodying the principles of the invention. Drain 10 comprises a relatively long rectangular form 12 and the same is mountable in a tile floor or wall such as 14. Projecting from a wall 16 of the drain 10 is a plurality of grating elements 18. The grating elements 18 are in spaced parallel relationship to direct flow through cells 20 which promote laminar water flow therethrough.

Figure 4:
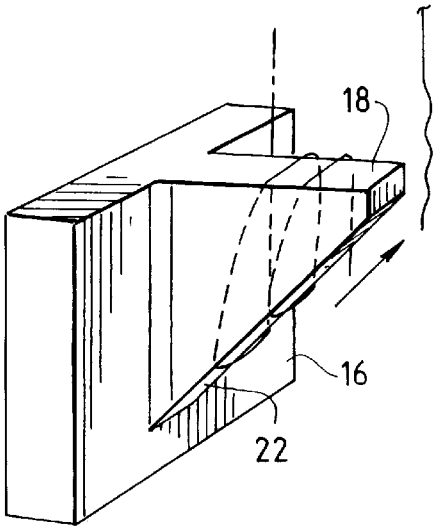
FIG. 4 is an enlarged fragmentary perspective view of a cantilevered element in the drain of FIG. 1 showing schematically the release therefrom of entangled hair.
Figure 5:
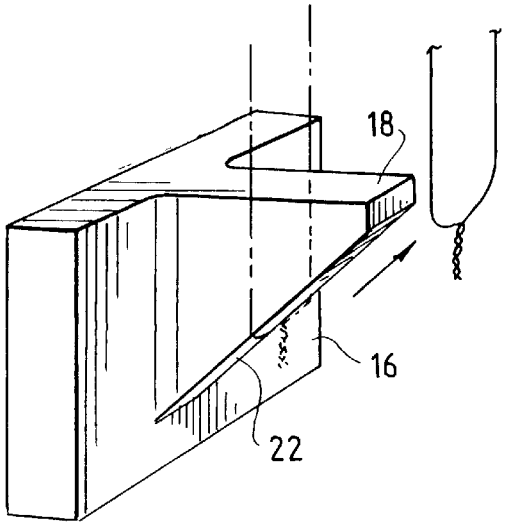
FIG. 5 is a similar view showing the release of knotted hair.

Referring more particularly to FIGS. 4 and 5, it will be seen that each of the grating elements 18 are cantilevered from the wall 16 and have a gradually tapered bottom surface 22. As indicated by the arrows, any hair which might become entangled (FIG. 4) or knotted (FIG. 5) about a grating element 18 can be slidably released with upward pressure because of the gentle sloping release surface 22.

Figure 2:
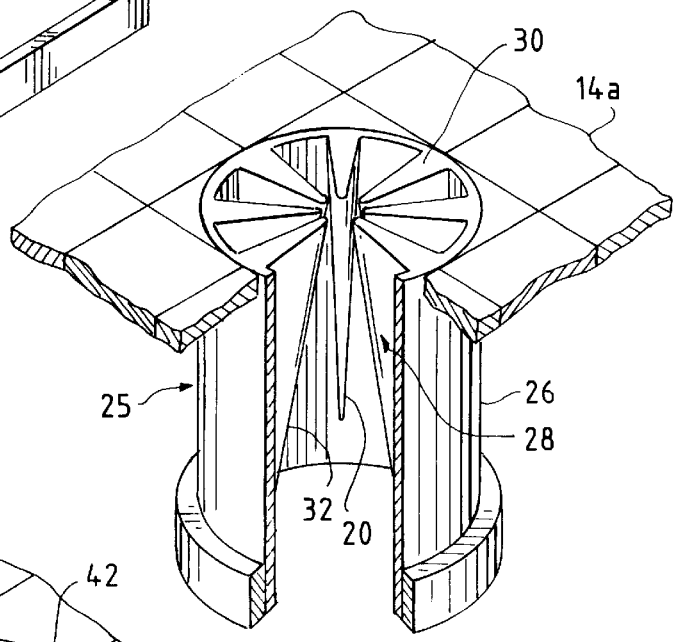
FIG. 2 is a similar view of another embodiment in circular form.

In FIG. 2 there is shown a drain 25 operationally mounted in a floor or wall 14*a*. In this embodiment of the invention, the drain 25 comprises an elongated cylinder 26. A plurality of cantilevered grating elements 28 are spaced radially around the inner wall of the cylinder 26. Each of the grating elements 28 comprises a flat top surface 30 and a tapered bottom release surface 32. Release of any entangled or knotted hair is facilitated by the tapered release surfaces 32.

Figure 3:
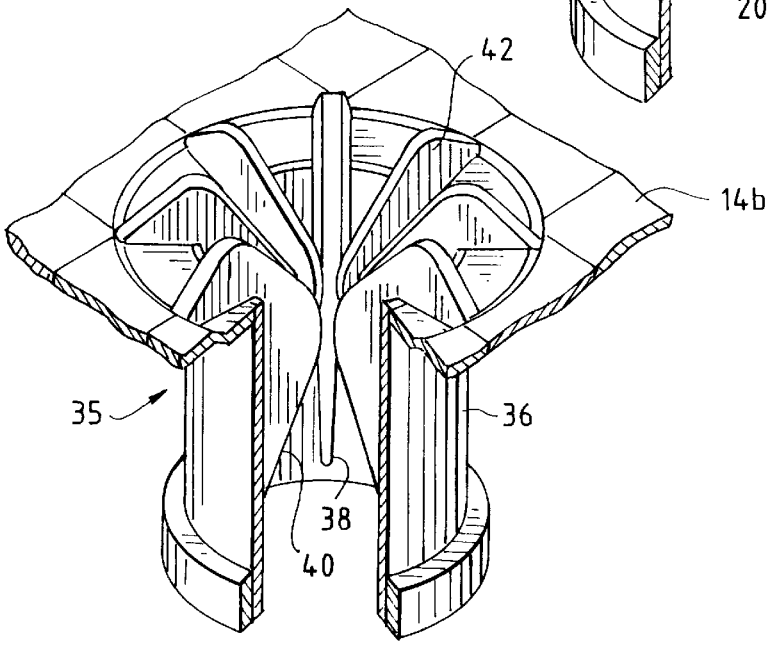
FIG. 3 is a similar view illustrating the circular form with a domed top structure.
Figure 6:
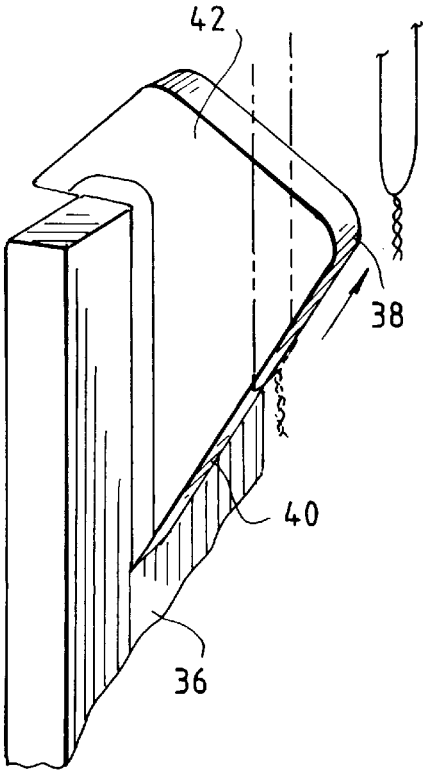
FIG. 6 is a fragmentary perspective view of a cantilevered element in the drain of FIG. 3.

FIGS. 3 and 6 show another embodiment of the invention. Drain 35 comprises an elongated cylinder 36. A plurality of cantilevered grating elements 38 are spaced radially around the inner wall of the cylinder 36. Each of the grating elements 38 comprises a tapered lower release surface 40. It should noted, however, that the top of the element 40 comprises angled or arcuate projections 42 that extend above the top of cylinder 36 as well as the supporting tile floor 14*b*. The combined projections 42 thus define a dome which serves to prevent complete vacuum-forming coverage of the drain 35 by the body of a bather.

Figure 7:
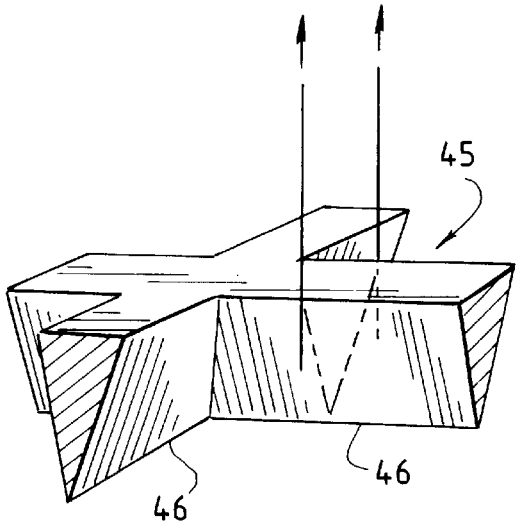
FIG. 7 is a fragmentary perspective view of a portion of a grating element of another embodiment of the invention.

FIG. 7 illustrates another form of grating element 45 designed to release entangled or knotted hair. The grating elements 45 are triangular in section and are provided with a sharp bottom edge 46. In the event of tangled or knotted hair, the sharp bottom edges 46 serves as release surfaces to sever and release the strands of hair upon upward pressure by the bather.

It should be appreciated that preferred embodiments of the invention have been described herein for illustrative purposes only and are not otherwise limiting of the structural concepts of the invention. Accordingly, changes and variations may be made by those skilled in the art without departing from the spirit and scope of the invention as defined in the appended claims.

What is claimed is:

1. A drain assembly for mounting in a pool comprising a drain body having an inner wall and an upper surface; a plurality of grating members cantilevered from said inner wall within said body which grating members are generally triangular in cross-section and have an outer surface extending inwardly and upwardly whereby any hair entangled or knotted on said outer surface will be released from said outer surface upon upward movement relative thereto.

2. A drain assembly as set forth in claim 1, in which the upper surface of said drain body is flat.

3. A drain assembly for mounting in a pool comprising a rectangular drain body having an inner wall and an upper surface, a plurality of grating members cantilevered form one wall thereof having an outer surface extending inwardly and upwardly whereby any hair entangled or knotted on said outer surface will be released from said outer surface upon upward movement relative thereto.

4. A drain assembly for mounting in a pool comprising a cylindrical drain body having an inner wall and an upper surface and a plurality of grating members cantilevered from said inner wall and extending toward the center of the drain body, which grating members have an outer surface extending inwardly and upwardly whereby any hair entangled or knotted on said outer surface will be released from said surface upon upward movement relative thereto, said grating members also comprising arcuate segments that project above the cylindrical wall, whereby the combined array of said members comprise a domed upper surface to prevent complete closing of the drain by the body of a bather disposed thereon.

5. A drain assembly for mounting in a pool comprising a drain body having an inner wall and an upper surface; and a plurality of grating members secured to said inner wall within said body, said members defining an outer surface located below said upper surface that extends inwardly and upwardly whereby any hair entangled or knotted on said outer surface will be released from said outer surface upon upward movement relative thereto.

6. A drain assembly as set forth in claim 5 in which the grating members are cantilevered from said inner wall.

7. A drain assembly as set forth in claim 6 in which said drain body is cylindrical and the cantilevered grating members extend toward the center of the drain body.

* * * * *